US006289305B1

(12) United States Patent
Kaja

(10) Patent No.: US 6,289,305 B1
(45) Date of Patent: Sep. 11, 2001

(54) METHOD FOR ANALYZING SPEECH INVOLVING DETECTING THE FORMANTS BY DIVISION INTO TIME FRAMES USING LINEAR PREDICTION

(75) Inventor: Jaan Kaja, Tyreson (SE)

(73) Assignee: Televerket, Farsta (SE)

( * ) Notice: Subject to any disclaimer, the term of this patent is extended or adjusted under 35 U.S.C. 154(b) by 0 days.

(21) Appl. No.: 08/129,077

(22) PCT Filed: Jan. 28, 1993

(86) PCT No.: PCT/SE93/00058

§ 371 Date: Mar. 2, 1994

§ 102(e) Date: Mar. 2, 1994

(87) PCT Pub. No.: WO93/16465

PCT Pub. Date: Aug. 19, 1993

(30) Foreign Application Priority Data

Feb. 7, 1992 (SE) ..... 9200349

(51) Int. Cl.[7] ..... G10L 19/04

(52) U.S. Cl. ..... 704/219; 704/201

(58) Field of Search ..... 395/2, 2.1, 2.18, 395/2.28; 381/39

(56) References Cited

U.S. PATENT DOCUMENTS

| | | | |
|---|---|---|---|
| 4,536,886 | 8/1985 | Papamichalis et al. | 395/2.28 |
| 4,625,286 | 11/1986 | Papamichalis et al. | 395/2.28 |
| 4,882,758 | 11/1989 | Uekawa et al. | 395/2.18 |
| 4,922,539 | 5/1990 | Rajasekaran et al. | 395/2.28 |

FOREIGN PATENT DOCUMENTS 0275584 7/1988 (EP) .

OTHER PUBLICATIONS

Parsons, *Voice and Speech Processing*, McGraw–Hill, New York, NY, (1987), p. 66,210–222.*

Nathan et al., "A Time–Varying Analysis Method for Rapid Transitions in Speech," IEEE Transactions on Signal Processing, Apr. 1991, 39(4):815–24.*

IEEE Transaction on Communication, vol. COM26, No. 3, Mar. 1978, Chong Kwan Un, "A Low–Rate Digital Formant Vocoder pp. 344–354", see II. system description.

* cited by examiner

*Primary Examiner*—Fan Tsang
*Assistant Examiner*—Michael N. Opsasnick
(74) *Attorney, Agent, or Firm*—Oblon, Spivak, McClelland, Maier & Neustadt, P.C.

(57) ABSTRACT

A process for speech analysis and more specifically an automatic process for the analysis of continuous speech. The waveshape of the speech is described with the aid of the resonant frequencies, formants, which arise in the speech organ. The process determines suitable frequencies for the formants from an utterance by dividing the utterance into time frames and analyzing the utterance by linear prediction in order to determine roots of the denominator polynomial and thereby frequency values for each frame. The utterance is divided into voiced regions and in each voiced region the centers of vowel sounds are established in order to obtain a number of starting points. Tracks are formed from the starting points by sorting the roots from frame to frame so that old and new roots are linked together. Factors of merit are calculated for the tracks relative to formants and the tracks are distributed to formants in accordance with the factors of merit. The factors of merit take into consideration the bandwidth, continuity and relation to the formants of the tracks. The process gives a global optimisation by delaying the formant allocation until a complete voiced region has been analyzed. By linking the tracks together in this way, additional/false resonances can be controlled, which resonances arise in association with linear prediction.

6 Claims, 4 Drawing Sheets

METHOD FOR ANALYZING SPEECH INVOLVING DETECTING THE FORMANTS BY DIVISION INTO TIME FRAMES USING LINEAR PREDICTION

FIELD OF THE INVENTION

The present invention relates to a process for speech analysis and more specifically to an automatic process for the analysis of continuous speech. The results of the invention can be used for speech recognition and for speech synthesis etc. It is conventional to describe the wave form of speech using those resonant frequencies, so-called formants, which arise in the speech organ. The present invention presents a process for determining suitable frequencies for the formants from an utterance.

STATE OF THE ART

There already exist known methods for determining formants. One such method uses linear prediction, which provides frequencies included in the utterance at sampled time points. The centre of each vowel is determined using low energy peaks and is set as the starting point. Proceeding from the starting point, the frequencies are allocated to known, previously estimated, intervals for the formants. Subsequently a matching is made to surrounding frames, forwards and backwards, in order to join the formants together over the whole vowel sound.

One problem with this known method is that when each time point or frame is determined individually, it is easy for the wrong decision to be made in the allocation of the frequencies to the formants, because additional, incorrect, resonances arise, e.g. in the case of nasal sounds etc. The present invention removes this problem by delaying the decision on the allocation of frequencies to the formants until the whole utterance has been analyzed.

SUMMARY OF THE INVENTION

Thus, the present invention provides a process for speech analysis comprising the recording of an utterance using some suitable device. The utterance is divided into time frames and is analyzed by linear prediction in order to determine the roots for the denominator polynomial and thereby frequency values for each frame. The utterance is divided into voiced regions and in each voiced region the centres of vowel sounds are determined using a number of starting points.

In accordance with the invention, tracks are formed from the starting points by the roots being sorted from frame to frame, so that old and new roots are linked together. Factors of merit are calculated for the tracks relative to the formants and the tracks are distributed to the formants in accordance with the factors of merit. The factors of merit are preferably calculated using energy factors, continuity factors and correlation factors.

Further embodiments of the present invention are given in more detail in the subsequent patent claims.

BRIEF DESCRIPTION OF THE FIGURES

The invention will be described in detail below with reference to the following figures, in which.

DETAILED DESCRIPTION OF THE PREFERRED EMBODIMENTS OF THE INVENTION

The waveshape of speech can be likened to the response from a resonance chamber, the voice pipe, to a series of pulses, quasi-periodic vocal chord pulses during voiced sounds or sounds produced in association with a constriction during unvoiced sounds. In shaping the voice pipe, resonance arises in various cavities as in an acoustic filter. The resonances are called formants and they appear in the spectrum as energy peaks at the resonant frequencies. In continuous speech the formant frequencies vary with time as the resonant cavities change position.

Figure 1:
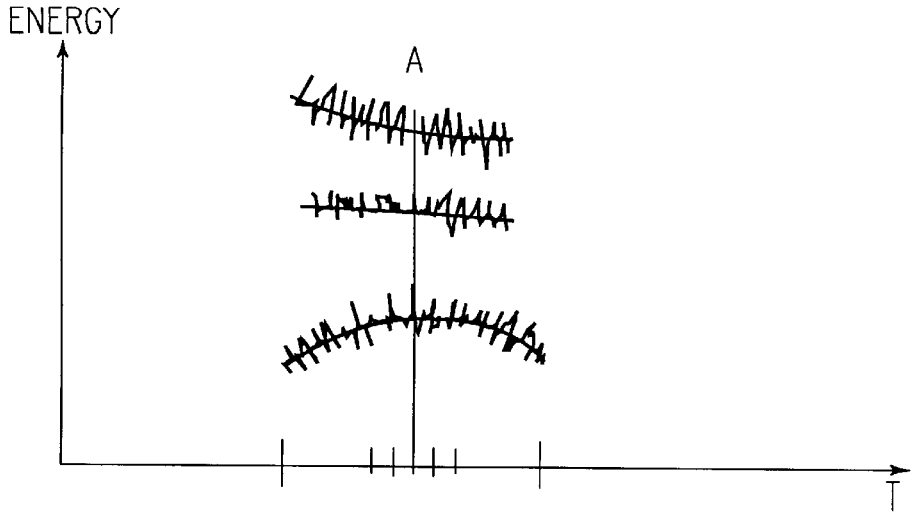
FIG. 1 shows an example of a spectrogram of a vowel sound.

A spectrogram of a vowel sound, e.g. "A", is shown in FIG. 1. It has been possible to produce spectrograms for a long time and linguists have studied them in order to be able to describe how speech is generated. Vowel sounds are usually characterised by the three first, strongest, formants. In FIG. 1 the formants are visible as dark bands which correspond to energy peaks from the point of view of frequency. The vowel sounds lie in the low frequency region, while consonants lie in high frequency regions, e.g. the s sound, and have a completely different appearance.

Figure 2:
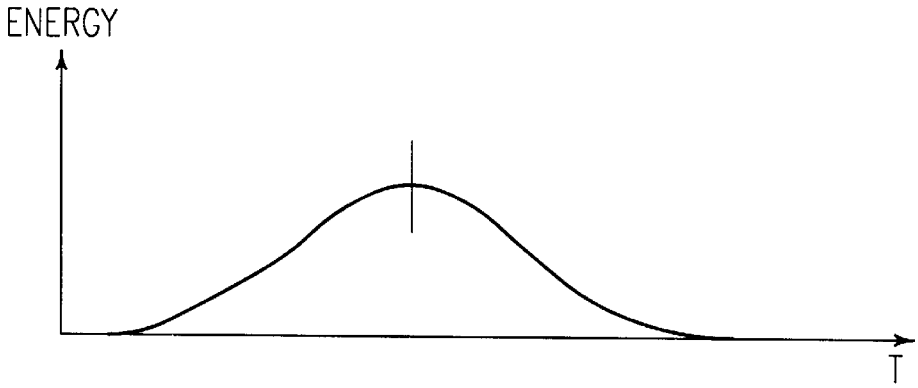
FIG. 2 is a curve of the low frequency energy.

The low frequency energy for the sound in FIG. 1 is shown in FIG. 2. It is evident that, from the point of view of time, the low frequency energy has a peak in the middle of the vowel sound.

The formants are thus important for describing the sound and are used, inter alia, for speech synthesis and speech recognition. An automatic process for speech analysis therefore has an important technical application.

Figure 3:
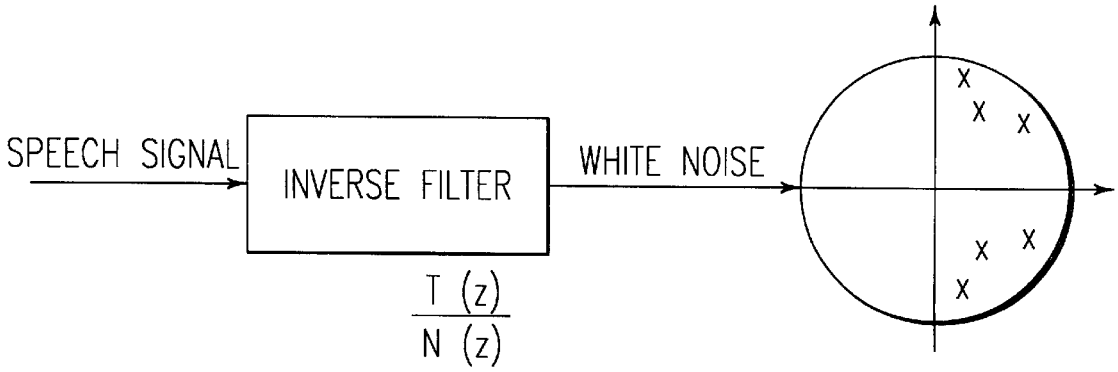
FIG. 3 diagramatically shows the model for analysis using linear prediction.

Linear prediction is a known method for analyzing a spoken utterance. The model for the analysis is shown in FIG. 3. One proceeds from a speech signal which is inverse filtered with a transfer function of $1/H(z)$ so that white noise is obtained. Consequently, the model assumes that the sound source is white noise, while in actual fact it is vocal chord pulses. This signifies an error in the model, but the method is still usable. By calculating the poles of the transfer function, i.e. the roots of the denominator polynomial $IH(z)$, which is a polynomial of $z^{-1}$, the frequencies are obtained as roots within the unit circle in the z plane. The frequencies are calculated, for example, every 5th ms, so that the spectrum is divided into frames of 5 ms. The utterance is recorded by some suitable recording device and is stored on a medium which is suitable for data processing.

Since, in the case of formant analysis, the main interest is in the vowel sounds, all the voiced regions in the recorded utterance are determined first of all. All the voiced regions with a minimum time length are ascertained. The unvoiced regions must also have a minimum length. The time length limitation is there in order to avoid possible mistakes in establishing voiced regions. Each voiced region is treated separately. They can in turn consist of several vowel sounds with interposed voiced consonant sounds, e.g. "mamma". The a's have corresponding peaks in the low frequency energy.

As mentioned earlier, the aim is to set starting points in the centers of the vowel sounds. For this reason, all the low frequency energy peaks which are separated by an energy drop exceeding a particular threshold, usually 3 dB, are identified. A low frequency energy peak of this type is shown in FIG. 2. A number of starting points are then obtained, one for each resonant frequency. A number of roots have thus been chosen for the frame which corresponds to the starting point.

The roots are then treated as follows. The roots at the starting point are arranged so that the roots with a bandwidth above a minimum value are placed first in increasing bandwidth order, followed by remaining roots in decreasing bandwidth order. The bandwidth of the roots is determined by their distance from the unit circle in the z plane. This rearrangement of the roots is not a critical part of the invention, but means that the roots do not have to be rearranged later. At this stage each root is considered as the seed for a "track" of roots which goes to the left and the right.

Figure 5:
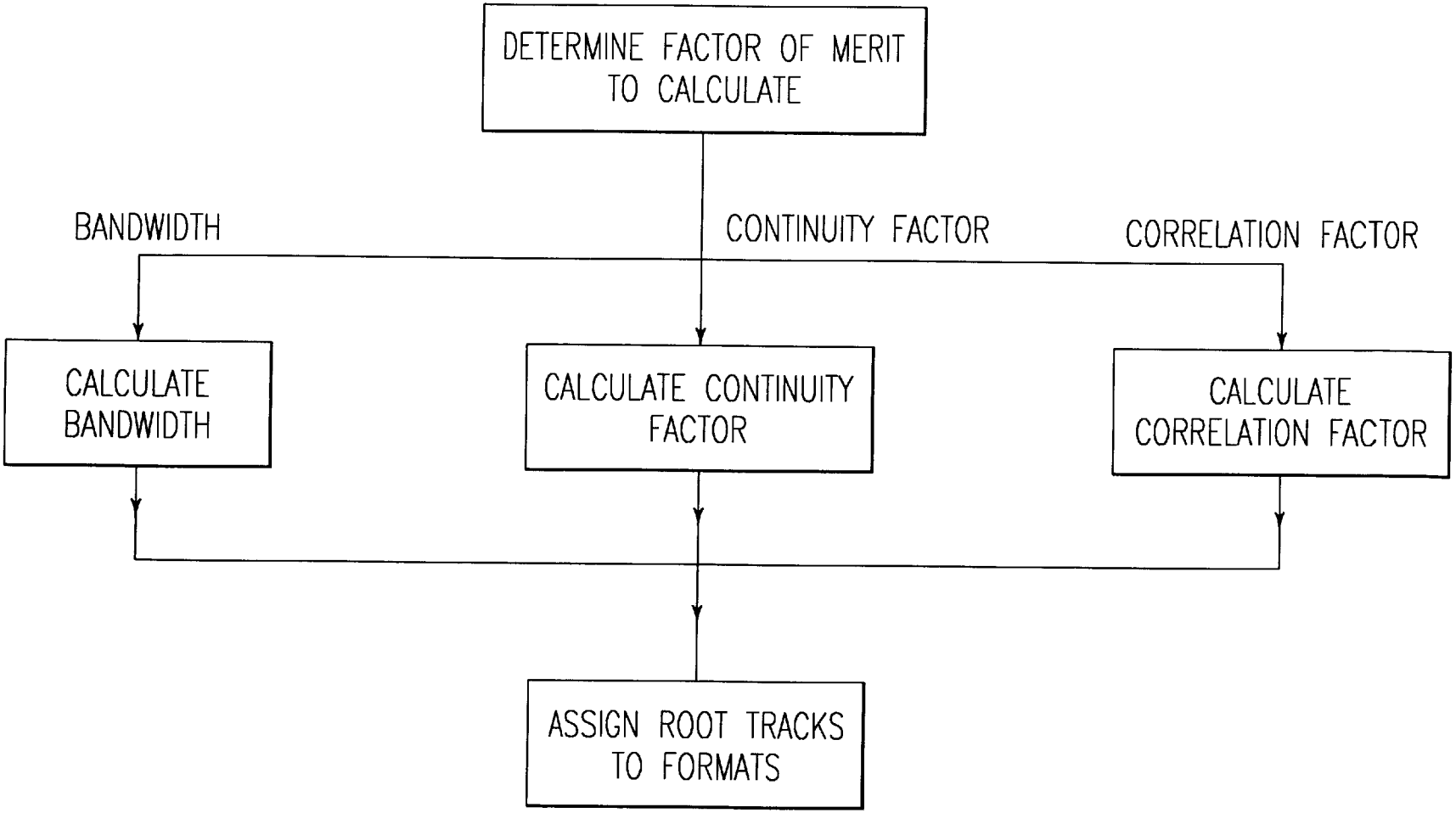
FIG. 5 is a flowchart depicting how root tracks are assigned to formant frequencies using bandwidth factors, continuity factors and correlation factors.
Figure 6:
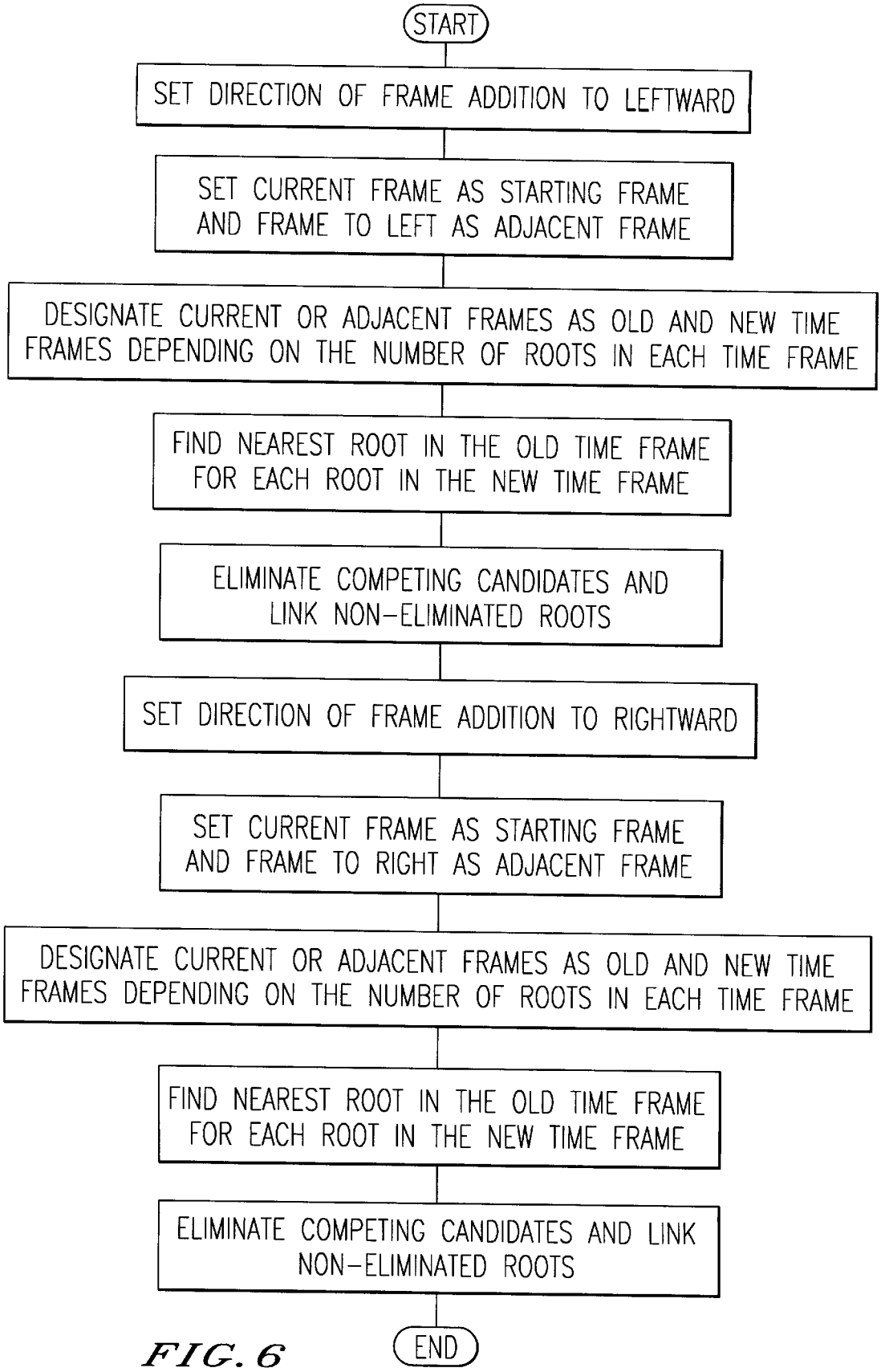
FIG. 6 is a flowchart depicting how root tracks are extended frame-by-frame.

The tracks are then extended as shown in FIG. 5 first to the left and then to the right, by sorting the roots frame to frame. The sorting procedure links together old and new roots by 1. going through all new roots and finding the nearest old root;
2. eliminating competing candidates by removing those which are farthest away;
3. going through all zero links and comparing with existing links. If the root which is associated with a zero link fits better than an existing link, these are exchanged.

The above procedure functions when the number of new roots is greater than or equal to the number of old roots. If the latter number is greater, the procedure is essentially the same, but the old roots are examined instead. Proceeding from the middle point of the vowel sound, a number of tracks are obtained.

The above procedure does not minimize the total distance between old and new roots, but retains tracks of roots, which lie close together, from frame to frame. The number of roots can vary from frame to frame, as a result of which "holes" arise in certain tracks. This is allowed to take place and is in fact an important aspect of the algorithm. If holes were not allowed, it would be necessary to decide on the identity of a track. Sometimes additional roots are also obtained which must be sorted in among the holes.

When tracks have thus been formed for roots over the whole utterance, the frequencies of the formants must be determined, i.e. the tracks sorted for the formants. Since there can be more tracks than formants, some of the tracks must be discarded. To do this, the factor of merit is calculated for each track as shown in FIG. 5 Firstly, two factors of merit are formed for each track, a bandwidth factor and a continuity factor. The bandwidth factor is formed by summing the square of the absolute quantity of the root for each root in the track. The bandwidth can be calculated as the distance of the root from the unit circle in the z plane. The continuity factor is calculated as 1− the square of the bandwidth for the square of the difference between roots in succession (i.e $$\left(i.e. \sum_i [1 - |\bar{r}_i - \bar{r}_{i-2}|^2]\right)$$

and is a measure of the distance between neighbouring roots.

Additionally, a further factor of merit, a correlation factor must be formed for each track in relation to each formant. In this way a vector with a correlation factor is obtained for each track, one for each formant. The correlation factor is calculated as the sum of the dependent probabilities that the particular root belongs to a formant. The vector is then multiplied by the square of the bandwidth factor and the square of the continuity factor in order to form the final "merit vector".

The merit vectors are then assembled into a merit matrix. The allocation of tracks to formants is then carried out by changing the columns around in the merit matrix so that the diagonal element is maximized with the stipulation that the average frequency of the appertaining tracks lies in ascending order. The first column in the arranged merit matrix thus corresponds to the first formant with the lowest frequency etc.

When all the voiced regions have been treated, the tracks are drawn from these into the unvoiced regions. A part of these extensions contains useful information, e.g. the tracks for the formants F2 and F3 from plosives to the following vowels.

Figure 4:
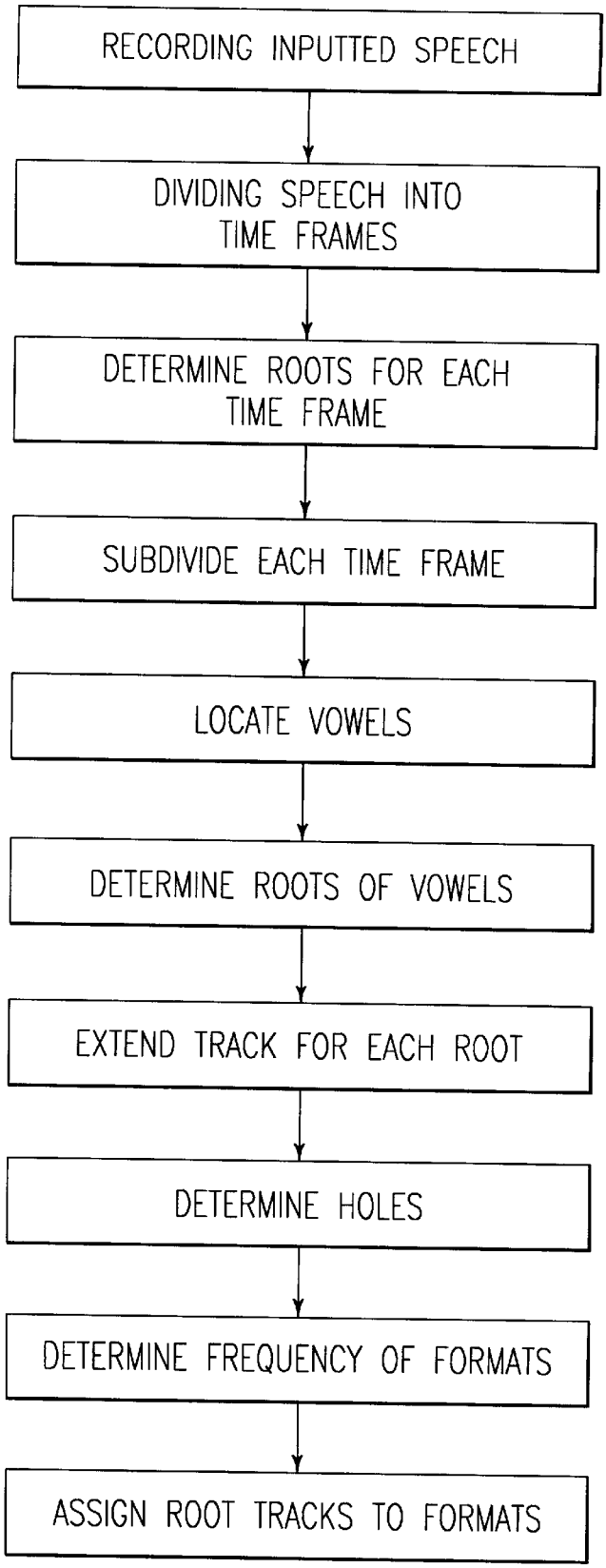
FIG. 4 depicts a flow chart of the present invention.

FIG. 4 shows a flow chart for the above-discussed process of the present invention.

The present invention thus provides a process for speech analysis which gives a more global optimization by delaying the formant allocation until a whole voiced region has been analyzed. If the formants are established for each frame separately, as in the previous technology, there are often errors, since additional/false resonances appear. By linking the tracks together using the method according to the invention, these additional resonances can be controlled. The method according to the invention rearranges the data recorded for the utterance. Thus, it is a non-destructive method insofar as the information is not altered. The extent of protection of the invention is only limited by the subsequent patent claims.

What is claimed is:

1. A method for analyzing a full voiced utterance in speech, comprising the steps of:

recording speech;

dividing the recorded speech into plural time frames;

finding roots for a denominator polynomial for each of the plural time frames;

identifying a complete voiced region in the plural time frames of the divided recorded speech;

selecting in said plural successive time frames of said voiced region a starting time frame which contains a low frequency energy peak indicative of a center of a vowel sound;

using roots of the starting time frame as seeds for producing plural root tracks;

extending the plural root tracks by linking corresponding roots of each preceding time frame in the complete voiced region to corresponding root tracks and by linking corresponding roots of each subsequent time frame in the complete voiced region to corresponding root tracks; and assigning a number of the plural root tracks to said number of formant frequencies representing the complete voiced region after the root tracks have been fully extended.

2. The method of claim 1, wherein the step of assigning said number of the plural root tracks to said number of formant frequencies comprises the steps of:

calculating factors of merit for each of the plural root tracks relative to said number of formant frequencies; and assigning said number of the plural root tracks to said number of formant frequencies based on the calculated factors of merit.

3. The method of claim 2, wherein the step of calculating factors of merit comprises the step of:

calculating, as said factors of merit, at least one of bandwidth factors, continuity factors, and correlation factors.

4. The method of claim 2, wherein the step of calculating factors of merits comprises the step of:

calculating, as said factors of merit, bandwidth factors as sums of distances of the roots from a unit circle in the z-plane, and continuity factors as sums of distances between roots of adjacent time frames.

5. The method of claim 2, wherein the step of calculating factors of merit comprises the step of:

calculating, as said factors of merit, correlation factors as sums of dependent probabilities that the roots belong to one of said number of formant frequencies.

6. The method of claim 1, wherein the step of extending the plural root tracks comprises the steps of:

(a) setting a direction for adding roots to the plural root tracks as going from the plural root tracks to a next preceding time frame in the voiced region which has not been added to the plural root tracks;

(b) designating the starting time frame as a current time frame and the next preceding time frame as an adjacent time frame;

(c) determining whether the current time frame or the adjacent time frame has more roots or if the current time frame and the adjacent time frame have an equal number of roots;

(d) designating as a new time frame the time frame determined to have more roots in step (c) and designating the other of the current time frame and the adjacent time frame as the old time frame if step (c) determines that the current time frame or the adjacent time frame has more roots;

(e) designating as a new time frame the adjacent time frame and designating the current time frame as the old time frame if step (c) determines that the current time frame and the adjacent time frame have an equal number of roots;

(f) finding a nearest root in the old time frame for each of the roots in the new time frame;

(g) eliminating competing candidates from the new time frame to the old time frame based on which root in the new time frame is closer to a common root in the old time frame;

(h) linking roots not eliminated in step (g) to corresponding root tracks;

(i) designating as the current time frame a time frame previously designated as the adjacent time frame;

(j) designating as the adjacent time frame a next adjacent time frame in the direction for adding;

(k) repeating steps (c)–(j) for all remaining adjacent time frames in the direction for adding in the voiced region;

(l) setting the direction for adding roots to the plural root tracks as going from the plural root tracks to a next subsequent time frame in the voiced region which has not been added to the plural root tracks;

(m) designating the starting time frame as the current time frame and the next subsequent time frame as the adjacent time frame; and (n) repeating steps (c)–(j) for all remaining adjacent time frames in the direction for adding in the voiced region.

* * * * *